US005142836A

United States Patent [19]

Kearns

[11] Patent Number: 5,142,836

[45] Date of Patent: Sep. 1, 1992

[54] WALL PANEL UNIT

[75] Inventor: David S. Kearns, Menomonee Falls, Wis.

[73] Assignee: Design House, Inc., Germantown, Wis.

[21] Appl. No.: 565,566

[22] Filed: Aug. 10, 1990

[51] Int. Cl.[5] ..... F04C 2/32; B44F 11/06

[52] U.S. Cl. ..... 52/314; 52/316

[58] Field of Search ..... 52/35, 314, 316, 311, 52/554, 555, 557, 558, 559

[56] References Cited

U.S. PATENT DOCUMENTS

| | | | |
|---|---|---|---|
| 448,732 | 3/1891 | Sagendorph | 52/314 |
| 3,217,453 | 11/1965 | Medow | 52/314 |
| 3,613,326 | 10/1971 | Mollman | 52/314 |

*Primary Examiner*—Michael Safavi
*Attorney, Agent, or Firm*—Fuller, Ryan, Hohenfeldt & Kees

[57] ABSTRACT

A wall panel which provides the attractive look of a tiled wall, but also includes a flat area without grout lines for accepting wallpaper or other decoration. The unit includes sheets of vacuum formed material, having formed in one face thereof a plurality of substantially identical regular polygonal shapes, such as squares, each of these shapes being generally immediately adjacent the neighboring shapes, so that the appearance of grout lines is formed between the adjacent shapes. At least one generally rectangular flat area is formed in the material, that flat area having one dimension substantially greater than the largest dimension of any one of the shapes. The width of the flat area is no larger than the largest dimension of any one of the shapes. Each sheet of material has a vertical edge flange portion formed along one entire vertical edge of the sheet, and adapted to be disposed in relation to a corresponding vertical edge of the next adjacent sheet in such a way that the next adjacent sheet overlies the edge flange. Resulting in the appearance of a smooth connection between adjacent sheets. Inner corner moldings and linear moldings ae provided for dressing the top edges of the sheets and for rounding out the physical installation of the sheets.

1 Claim, 1 Drawing Sheet

WALL PANEL UNIT

BACKGROUND OF THE INVENTION

This invention relates to a wall panel unit, such as for use in a bathroom or other area where the appearance of tiled walls is appropriate, generally outside the bath alcove, and particularly to vacuum formed wall panel units similar to those used for tub surrounds.

It is well known to provide tiled walls in bathrooms, and the appearance of these tiled walls has wide appeal. Commonly these tiles are square or have some other regular polygonal shape, with indented grout lines between adjacent tiles. To further decorate tiles such as these, it is known to apply individual decals to particular tiles, with the attendant expenditure of time. Application of wallpaper, though, to cover or decorate a number of tiles at once, is complicated by the indentations of the grout lines.

The concept of bathroom tub surrounds is also known, as evidenced by U.S. Pat. Nos. 4,067,071; 4,228,552; 4,671,026; and 4,817,344. Each of these patents, however, shows that the tub surround includes large flat areas, not having the same appeal as that given by the appearance of tiles.

This invention relates to improvements over the apparatus described above and to solutions to the problems raised or not solved thereby.

SUMMARY OF THE INVENTION

The invention provides a wall panel which yields the attractive look of a tiled wall, but also includes means for accepting wallpaper in certain areas without grout lines.

The invention includes a wall panel unit comprising a single sheet of vacuum formed material. In one face of that single sheet is formed a plurality of substantially identical regular polygonal shapes, such as squares, each of the shapes being generally immediately adjacent the neighboring shapes, so that the appearance of grout lines is formed between the adjacent shapes. At least one generally rectangular flat area is formed in the material, that flat area having one dimension substantially greater than the largest dimension of any one of the shapes. The width of the flat area is no larger than the largest dimension of any one of the shapes. Each sheet of material has a vertical edge flange portion formed along one entire vertical edge of the sheet, and adapted to be disposed in relation to a corresponding vertical edge of the next adjacent sheet in such a way that the next adjacent sheet overlaps the edge flange. Thus is created a smooth appearance between adjacent sheets. Inner corner molding means and baseboard molding means are provided for covering the junction between two adjacent sheets at an interior corner, and for covering the junction between the bottom edge of a sheet and the floor, respectively.

Other objects and advantages of the invention will become apparent hereinafter.

DESCRIPTION OF THE PREFERRED EMBODIMENTS

Figure 1:
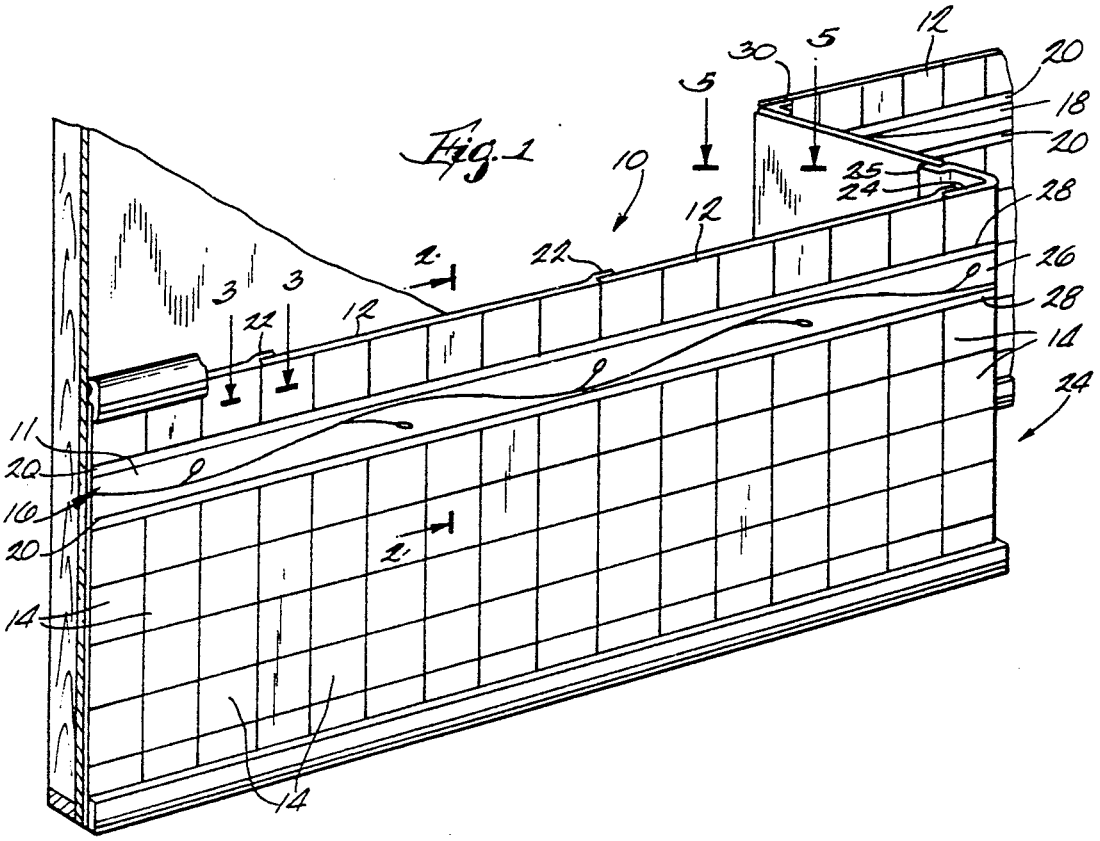
FIG. 1 is a perspective view of a wall panel unit assembled from a group of individual sheets and moldings according to a preferred embodiment of the invention.

Referring now to FIG. 1, there is shown a wall panel unit 10 assembled from a number of individual sheets 12 of material. Preferably each of these sheets 12 is formed, such as by vacuum forming, so as to have on one face thereof a plurality of substantially identical regular polygonal shapes, such as the squares 14 shown in FIG. 1. Preferably each of the shapes is positioned generally immediately adjacent the neighboring shapes. According to the invention, least one flat area 16, generally rectangular in shape, is formed in the sheet material 12. As shown in FIG. 1, this flat area 16 has one dimension, the horizontal dimension as depicted in that drawing figure, which is substantially greater than the largest dimension of any one of the shapes 14, and in fact runs the entire horizontal dimension of the sheet 12. The transverse direction, vertical in FIG. 1, however, is about the same as the largest dimension of one of the shapes 14. This flat area 16 may be decorated with any suitable ornamentation such as a wallpaper border, stencilling or other means which may be applied to a flat surface.

Figure 2:
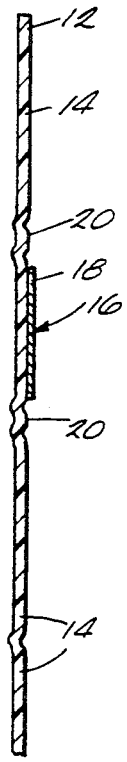
FIG. 2 is a cross sectional view of the assembly shown in FIG. 1, taken along line 2—2, on an enlarged scale, showing the cross-sectional shape of a sheet of material according to the invention.

In one embodiment, as also shown in section on FIG. 2, the flat area 16 may be divided horizontally further into a wider strip 18 and two narrower strips 20, one on each side of the wider strip 18, all three strips running the length of the sheet 12.

Figure 3:
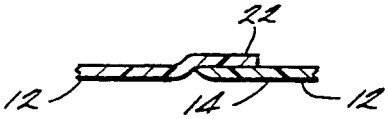
FIG. 3 is a cross sectional view of the assembly show in FIG. 1, taken along line 3—3, showing the flange and overlap according to the invention.

By comparing FIG. 3 to FIG. 1, it can be seen that adjacent sheets 12 are joined together to form a wall panel unit 10 by means of a vertical edge flange portion 22, formed along one entire vertical edge of the sheet. This flange 22 is adapted to be disposed in relation to a corresponding vertical edge of the next adjacent sheet 12 in such a way that the next adjacent sheet overlaps the flange. A smooth appearance is thus created between adjacent sheets 12, to again facilitate the application of decoration to the flat area 16 or the strips 18 and/or 20.

As can be seen at FIG. 1, the invention also calls for an outside corner piece 24 which has matching strips, a wider strip 26 and narrower strips 28 on each side thereof, formed in the corner piece to correspond to the strips 18 and 20 formed in the sheets 12. The outside corner piece 24 ensures the smooth continuance of the flat area 16 around the outside of a corner if the installation calls for such continuance. As with the sheets 12 themselves, the outside corner piece 24 includes a vertical edge flange 25 formed along one entire vertical edge of the corner piece. Similar to flange 22, this flange 25 is adapted to be disposed in relation to a corresponding vertical edge of the adjacent sheet 12 in such a way that the sheet overlaps the flange. The other side of the corner piece 24 overlies the flange 22 of the adjacent sheet 12. A smooth appearance is thus created from one sheet 12 to the corner piece 24 and continuing to the next sheet 12, to again facilitate the application of decoration to the strips 18 and 26.

Figure 4:
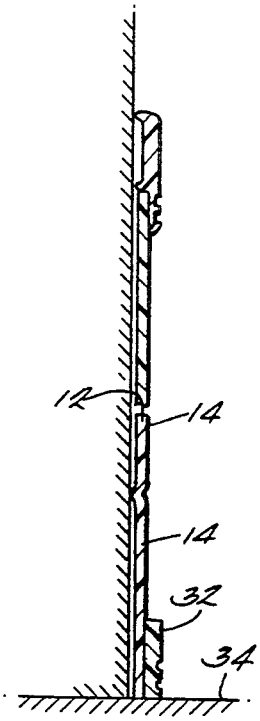
FIG. 4 is a cross sectional view of the assembly shown in FIG. 1, taken along line 4–4, showing a baseboard mounted according to the invention.
Figure 5:
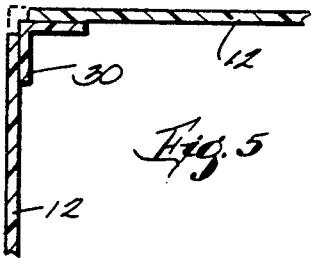
FIG. 5 is a cross sectional view of the assembly shown in FIG. 1, taken along line 5—5, showing an inside corner molding mounted according to the invention.

Linear moldings 32*a* and 32*b*, as shown in FIG. 4, are also provided. These may be used for dressing the top edge of a sheet 12 (referring to stepped molding 32*a*), or for covering the junction between the bottom edge of a sheet 12 and the floor 34, as a baseboard molding (referring to flat-backed molding 32*b*). As can be seen at FIG. 5, in order to round out the physical installation of the sheets 12, there are provided inner corner moldings 30 for covering the junction between two adjacent sheets 12 at an interior corner.

While the apparatus hereinbefore described is effectively adapted to fulfill the aforesaid objects, it is to be understood that the invention is not intended to be limited to the specific preferred embodiments of wall panel unit set forth above. Rather, it is to be taken as including all reasonable equivalents within the scope of the following claims

I claim:

1. A wall panel unit suitable for assembly with a plurality of similar panel units to form a composite wall surface having the appearance of a tiled wall formed form individual tiles comprising:

a single sheet of vacuum formed material, having formed on one face thereof a plurality of substantially identical regular polygonal shapes, each of said shapes being immediately adjacent the neighboring shapes and being joined by surface indentations, thereby providing the appearance of individual tiles joined by grout; and at least one horizontally oriented generally rectangular flat area formed in said material, said flat area having a horizontal dimension substantially greater than the largest dimension of any one of said shapes, and the length thereof extends substantially the entire width of said sheet, the width of said flat area being no less than the largest dimension of said shapes, and further comprising trim strips, one on each side of and running the full length of said flat area, said trim strips being substantially narrower than said flat area.

said sheet further comprising a vertical edge flange portion formed along one entire vertical edge of said single sheet of material, adapted to be disposed in relation to a corresponding vertical edge of another one of said sheets placed adjacent to said sheet in such a way that the next adjacent sheet overlaps said edge flange, for creating a smooth appearance between adjacent sheets.

* * * * *